US005388440A

United States Patent [19]

Folmer

[11] Patent Number: 5,388,440

[45] Date of Patent: Feb. 14, 1995

[54] METHOD FOR FORMING LARGE 360 DEGREE SHEET METAL SHAPES USING LONGITUDINAL END LOADING

[76] Inventor: Carroll W. Folmer, 29781 Pebble Beach Dr., Sun City, Calif. 92586

[21] Appl. No.: 95,686

[22] Filed: Jul. 21, 1993

[51] Int. Cl.[6] ..... B21D 39/08; B21D 26/02

[52] U.S. Cl. ..... 72/62; 72/58

[58] Field of Search ..... 72/56, 58, 62, 61; 29/421 R

[56] References Cited

U.S. PATENT DOCUMENTS

| | | | |
|---|---|---|---|
| 2,631,640 | 3/1953 | Zallea | 72/58 |
| 3,335,590 | 8/1967 | Early | 72/58 |
| 3,611,768 | 10/1971 | Odagaki | 72/58 |
| 3,974,675 | 8/1976 | Tominaga | 72/58 |
| 4,414,834 | 11/1983 | Gratzer et al. | 72/58 |
| 5,097,689 | 3/1992 | Pietroban | 72/58 |
| 5,214,948 | 6/1993 | Sanders | 72/58 |

FOREIGN PATENT DOCUMENTS

| | | | |
|---|---|---|---|
| 0237128 | 9/1987 | European Pat. Off. | 72/58 |
| 0049735 | 3/1986 | Japan | 72/58 |
| 1433582 | 10/1988 | U.S.S.R. | 72/58 |

*Primary Examiner*—David Jones

[57] ABSTRACT

A method for reshaping 360° sheet metal cylinders by longitudinal end loading simultaneous with gas pressure applied to the inside of the cylinder directing the metal into dies resulting in new shapes without thinning, in a clean atmosphere.

5 Claims, 9 Drawing Sheets

METHOD FOR FORMING LARGE 360 DEGREE SHEET METAL SHAPES USING LONGITUDINAL END LOADING

BACKGROUND—CROSS-REFERENCES TO RELATED APPLICATIONS

This invention is being submitted to use the facility, depicted in patent application "A METHOD OF HEAT ASSISTED SHEET METAL FORMING IN 360 DEGREE SHAPES."

BACKGROUND—FIELD OF INVENTION

This invention relates to the forming of sheet metal shapes for the aerospace and related industries.

BACKGROUND—DESCRIPTION OF PRIOR ART

There are factories and subcontractors who produce the leading edge inlet skins and related shapes depicted. They have established a history of success in forming leading edge inlet skins in large presses and drop hammer presses. Some vendors utilize explosive forming. Others use spin forming if the inlet lips are circular.

Although they have established a successful history, forming of inlet leading edge skins, normally called nose lips, in the presses or drop hammers suffers from a number of disadvantages:

(a) The sheet metal shape of an inlet leading edge skin is usually attained by pressing a male plug into a female die. When formed in this manner the nose lip has a tension side and a compression side. Wrinkling is very common on the compression side as there is more material available than die surface. To avoid wrinkling, the material is held at the edges and forced to thin in order to avoid wrinkling. Engineers always specify minimum thicknesses forcing the producer to allow extra thickness and grinding or chem-milling to meet the engineering specification.

(b) Spin forming can only be used if the part is circular or very near circular. It has the advantage of low cost tooling but the disadvantage of non-uniform thickness and has trouble meeting the engineering specifications of thickness.

(c) Explosive form avoids the use of male and female matched dies but again the material is formed by thinning and meeting the engineering specification of thickness is difficult.

There are patents in existence which utilize longitudinal end loading in conjunction with internal axial pressure loading, either gas or hydraulic. The most similar found were U.S. Pat. Nos. 3,611,768, 5,097,689, and 5,214,948.

They fill the entire inside of the blank cylinder with gas or fluid as they apply longitudinal end pressure. This is not practical in my invention as the internal diameter to produce aircraft nacelle inlet leading edge skins, nose lips, is huge. The diameters vary from 3 feet to 10 feet. I found it necessary to reduce the volumn of pressure and did so by adding an internal sleeve, multipurpose holder 32, to limit the amount of gas or hydraulic fluid required and to resist pressures. The holder serves other purposes such as holding the double action actuator and system piping.

U.S. Pat. No. 5,214,948, Sanders, was able to form superplastic blanks by allowing the material to free form until the dies touched and then finished the process. Again this is impractical in my invention due to the size and cost of such a large press. In my invention it is necessary to fix the dies and apply pressure to each end of the blank. The material of choice in my invention is 2219 Aluminum as that is what the current aircraft nacelle inlet leading edge skins are made from. 2219 Aluminum is not superplastic but, stage annealing can be used.

Large structures such as those in my invention can be produced more cost effectively by optimizing and utilizing facilities that are designed to produce the product as opposed to products being designed to fit the facility.

OBJECTS AND ADVANTAGES

Accordingly, besides the objects and advantages of the sheet metal inlet forming method described in my patent, several objects and advantages of the present invention are:

The material for the sheet metal inlet and similar shapes comes from the longitudinal dimension of the preform, not from the diameter. Gas or hydraulic fluid directs the material into the die as end load pressure is applied from a double action actuator as directed from a controller. The result is a sheet metal shape without thinning that a part or parts can be trimmed from.

A 360° sheet metal shape can be formed in a singular female die.

Aluminum parts can be formed in the as clad condition, without scratches, as smooth plastic faced dies can be used.

Perforated parts, that will not hold pressure, can be formed by combining them with a slave sheet. This results in the minimum elongation of perforated holes as there is no diametrical forming. There is merely a change in shape.

Thermoplastic parts can be formed by combining them with a slave sheet.

Single stage forming is used. Other methods require several stages.

DRAWING FIGURES

FIG. 1 shows an overall view of the basic facility.

FIG. 2 shows sheet metal being prepared as a preform by being welded, rolled, and roll planished into a 360° shape.

FIG. 3 shows a before and after shape of a 360° sheet metal shape.

FIG. 4 shows a view looking down on the case.

FIG. 5 shows a section cut through a sheet metal shape and the facility.

FIG. 6 shows a view of the O-Ring sealing at the plunger.

FIG. 7 shows a view of the sheet metal shape sealed with inflatable seals.

FIG. 8 shows a before and after shape of a detail formed in a female die.

FIG. 9 shows a nose lip formed on a male die mated to a bulkhead formed in a female die.

REFERENCE NUMERALS IN DRAWINGS

14 Overhead Transfer Beam
16 Part loading Winch
18 Case and Die Winch
20 Controller and Recorder
22 Hydraulic Triple Die Positioning Base
24 Holder Mount Ring
26 Preform 26B Formed Shape From 26
26C Part From 26B
28 Case
30 Die-Upper
30B Die-lower
32 Multi-Purpose Holder
34 Double Action Actuator
36 Plunger
38 O-Ring Seal- Plunger to Holder
40 O-Ring Seal- Plunger to Part
42 Forming Pressure Tube
44 Delivery Tube-Actuator
46 Perforated Sheet
46B Perforated Sheet After Forming
48 Holder Support Structure
50 Seal-Case to Base
52 Inflatable Seal- Plunger to Part
54 Inflatable Seal- Plunger to Holder
56 Delivery Tube- Inflatable Seals
58 Thermoplastic Sheet
58B Thermoplastic Sheet After Forming
60 Preform
60B Formed Shape From 60
60C Part From 60B

Figure 1:
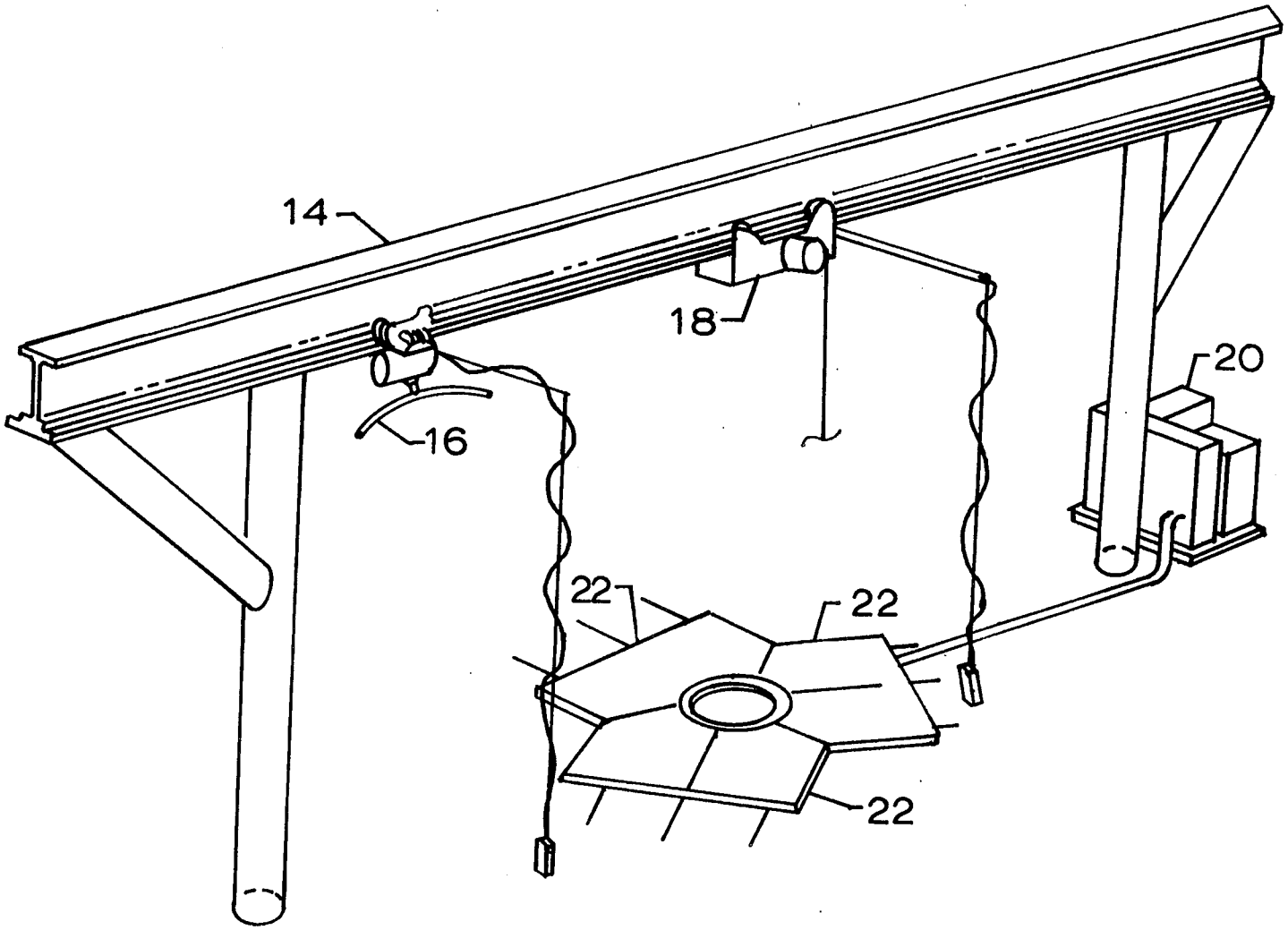
FIG. 1, is schematic and is intended to present an overview of the basic facility. It consist of a basic framework 14, that supports a part handling winch 16, and a die and case handling winch 18. A controller/recorder 20 directs the hydraulic Die Positioning Base 22 to and from the holder mount ring 24. The facility is designed to handle singular, dual, and triple dies. Die movement is vertical for this example.
Figure 2:
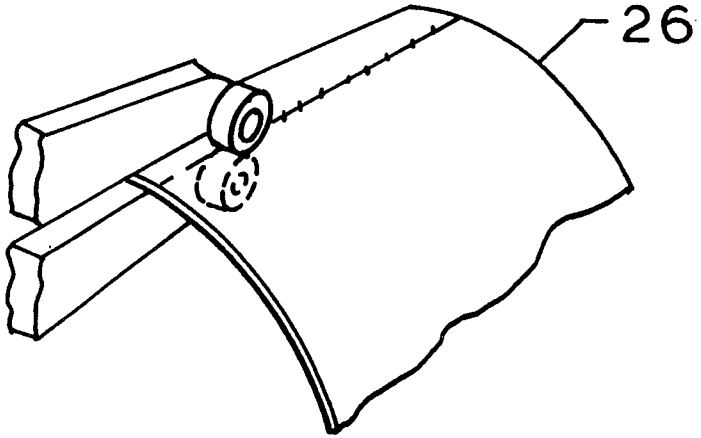
FIG. 2, shows sheet metal being prepared as a preform 26 by being welded, rolled, and planished into a 360° shape. The preform for sheet metal inlets and similar shapes is usually circular, but it can be conical.
Figures 3A, 3B:
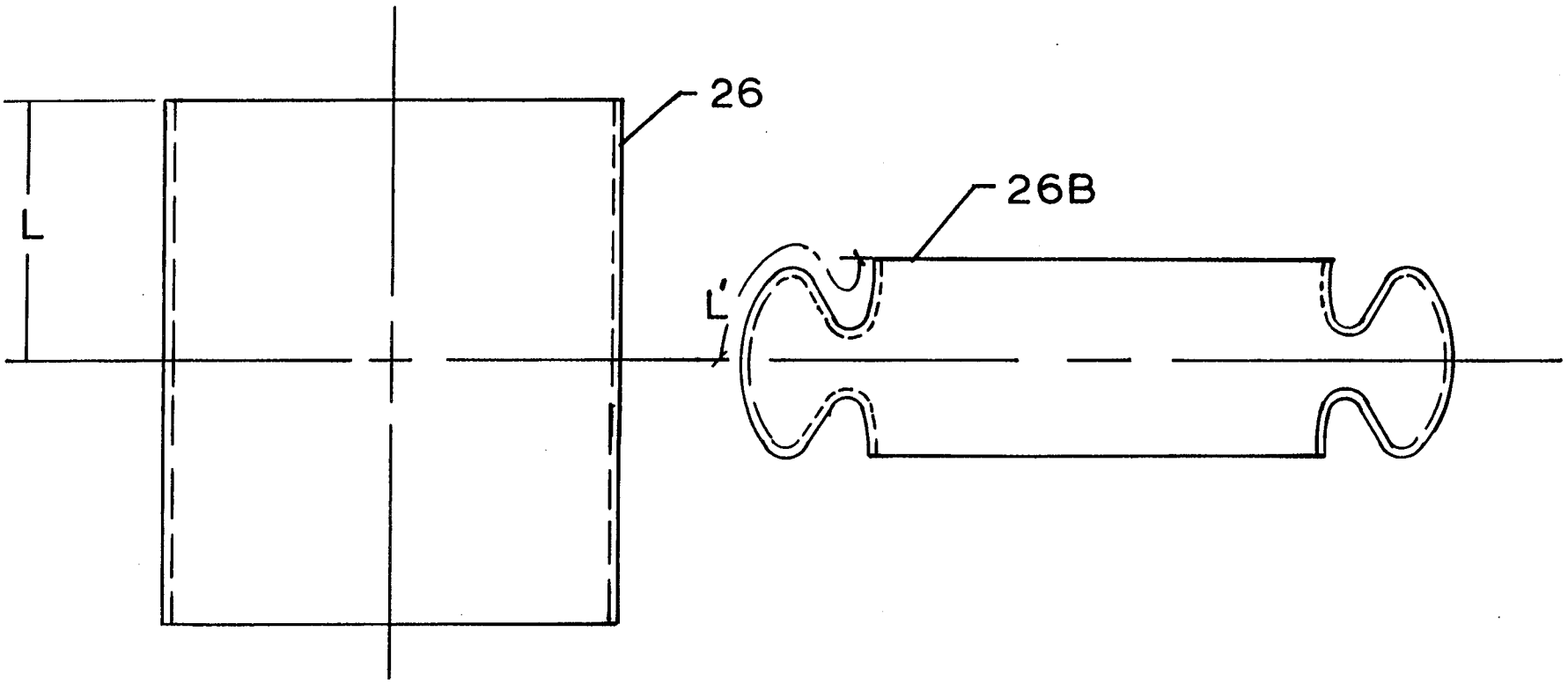
FIG. 3, shows before 26 and after 26B shape of a 360° shape. The preform shape 26 is circular. The area indicated L' on the 26B does not have to be circular but its length L' must approximate the preform length L.
Figure 4:
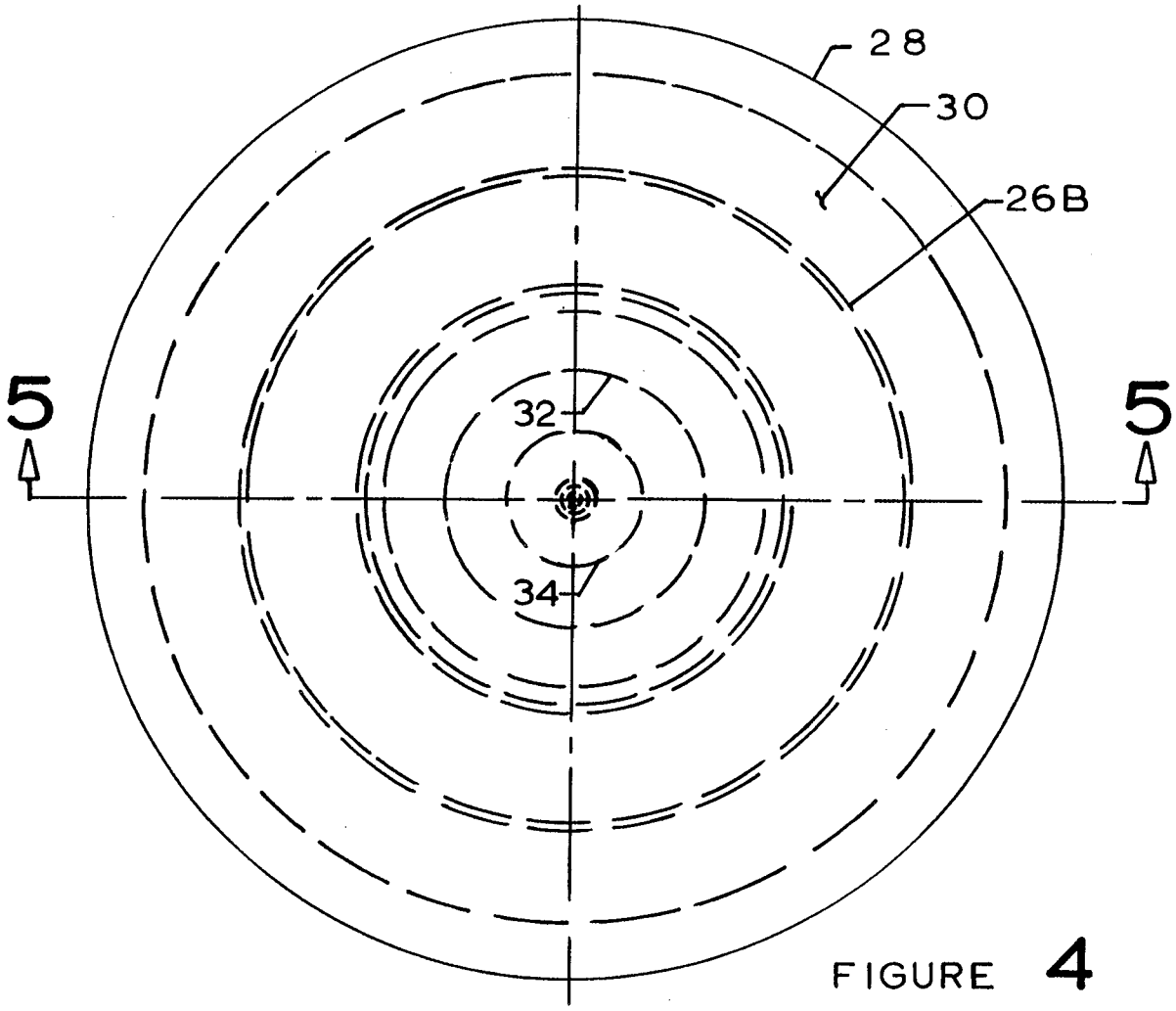
FIG. 4 is a view looking down on the case 28, die 30, sheet metal shape 26B, heater core holder 32, and the double-action actuator 34. It emphasizes the 360° circular design.
Figure 5:
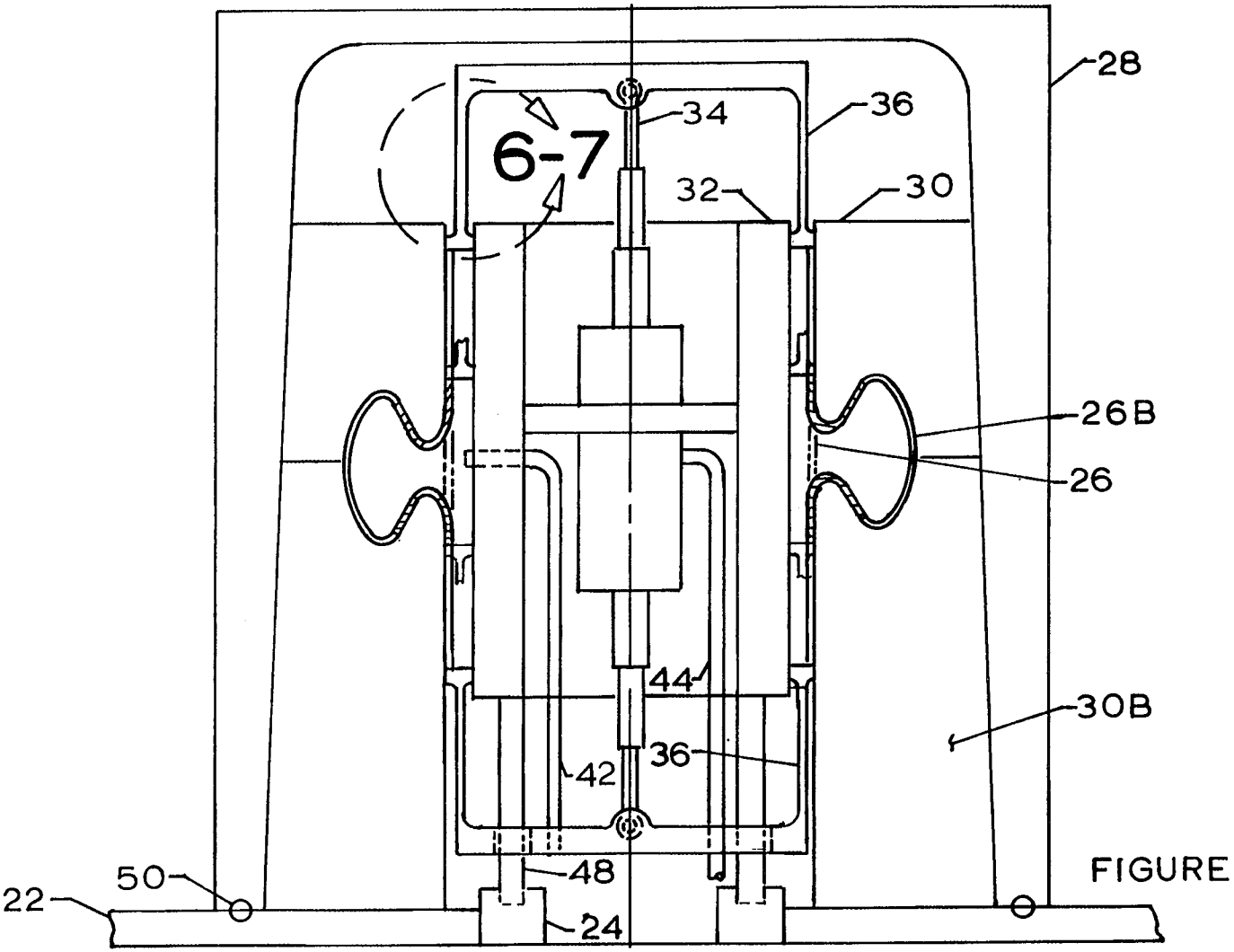
FIG. 5 is a section cut through the sheet metal shape and the facility. The heater core holder 32 is connected to the holder mount ring 24 with a framework 48. The heater core holder 32 supports the double-action actuator 34 which is connected to plungers 36 at each end. It depicts the preform 26 in the extended position. It depicts 26B in the formed position inside the dies 30 and 30B. The controller/recorder causes hydraulic fluid to be delivered through 44 to the actuator, as it simultaneously causes gas or hydraulic fluid to be delivered through 42 to the inside face of 26. The case 28 surrounds the dies and resist any pressures.
Figure 6B:
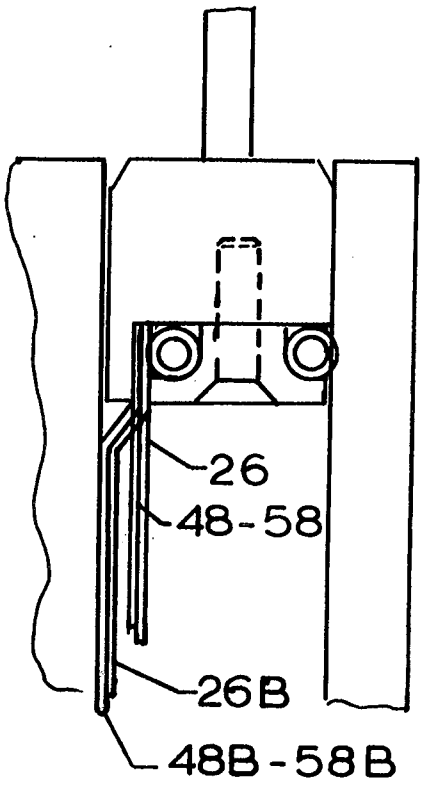
FIG. 6 is an enlargement of the section at the interface of the plunger 36, sheet metal shape 26, and the multi-purpose holder 32. O-Rings 38 and 40 are retained with a removable retainer 36B. O-Ring 38 effects a seal between the plunger 36 and the multi-purpose holder 32. O-Ring 40 effects a seal between the plunger 36 and sheet metal shape 26. Forming pressure will force the sheet metal shape to contact the die 30 as the plunger 36 end load the sheet metal shape. An alternate view is provided that shows sheet metal shape 26 utilized as a slave sheet to form a perforated sheet 46 incapable of holding pressure. The slave sheet 26 will also be used to form a thermoplastic sheet 58 that requires heat. The slave sheet circular preform 26 can be either rubber or sheet metal depending on temperature.
Figure 6A:
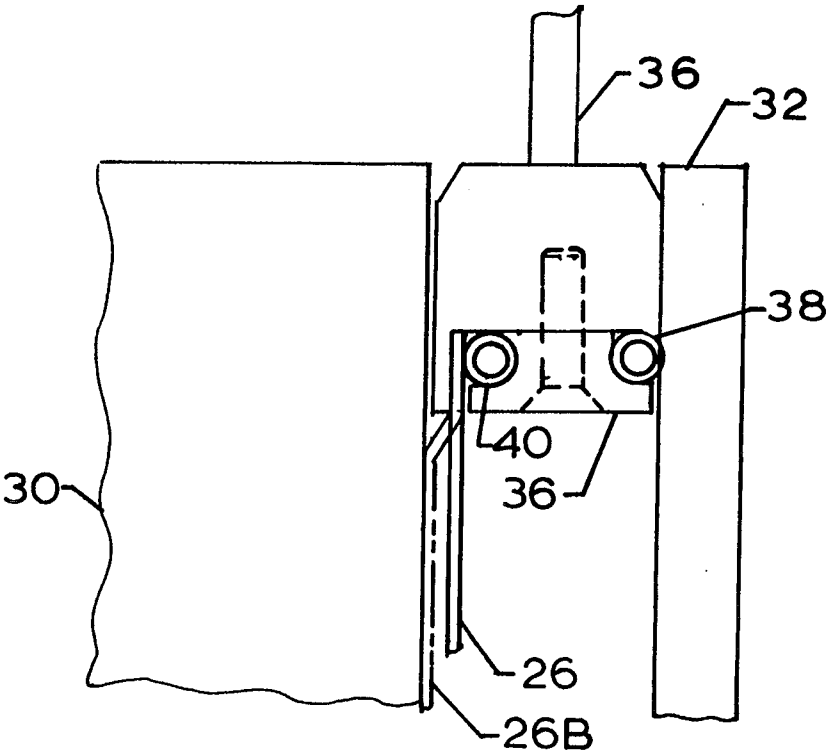
Figure 7:
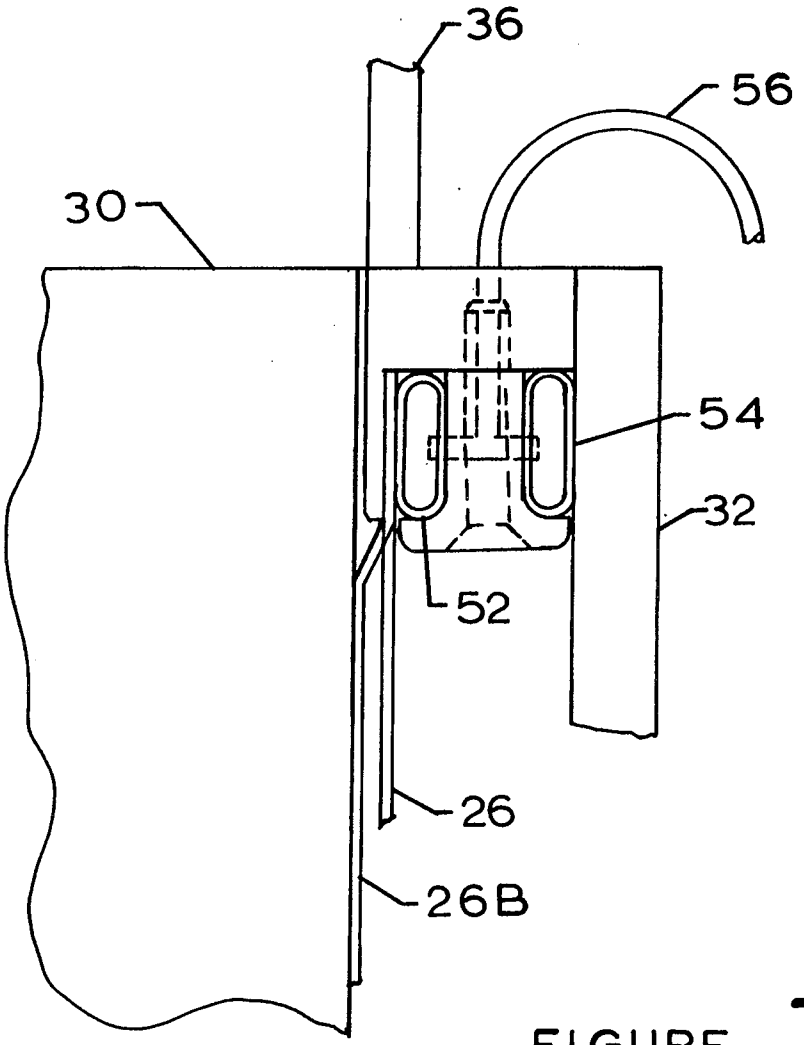
FIG. 7 is an alternate method of sealing the sheet metal shape at the plunger ends. Inflatable seals are used in place of the o-rings.
Figures 8A, 8B:
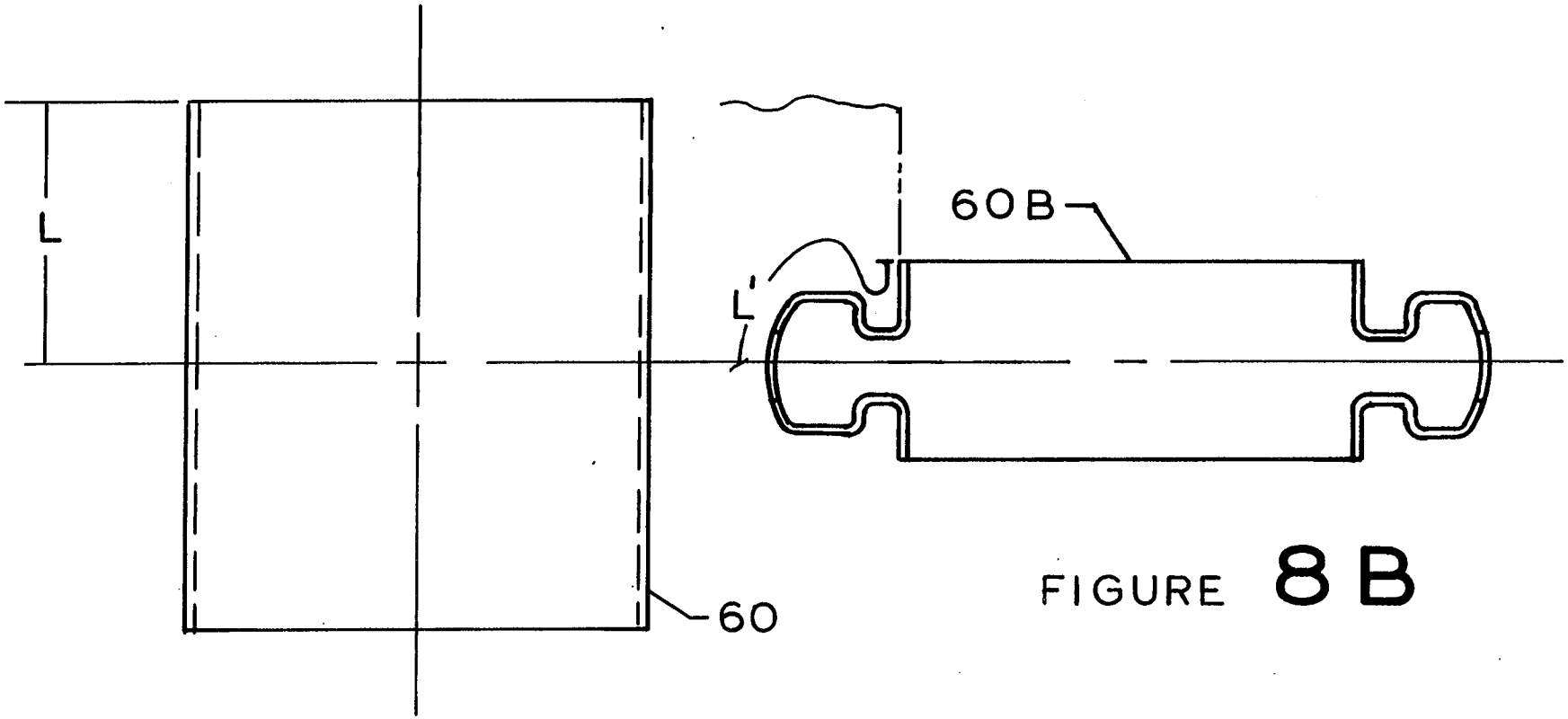
FIG. 8 shows before 60 and after 60B shape of a 360° shape. The shape is formed in a female cavity.
Figure 9:
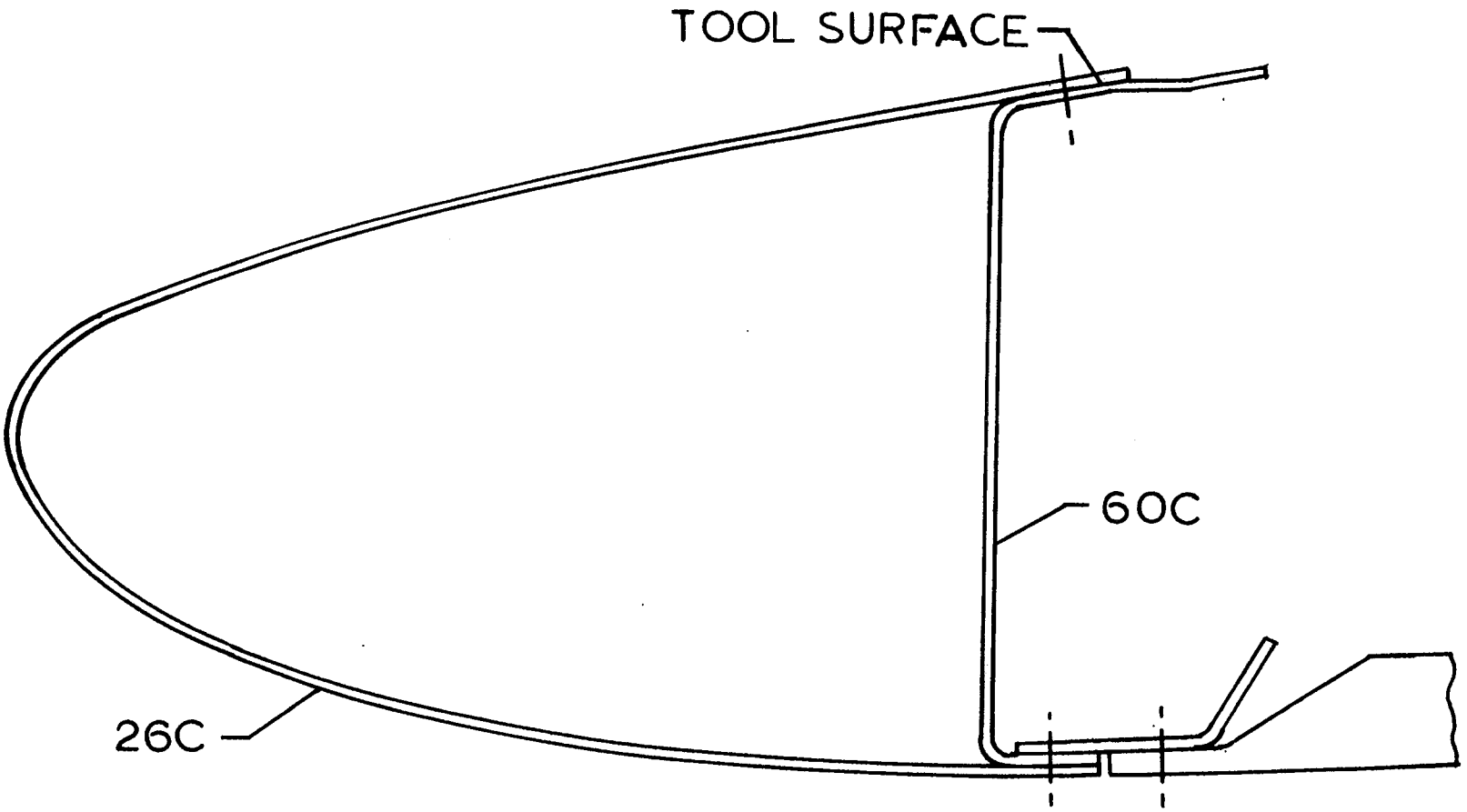
FIG. 9 shows 26C part mated to 60C part. 26C was formed on a male die while 60C was formed in a female die in order to demonstrate a common tool line for the best possible fit.

From the description noted, a number of advantages of my end loaded forming method becomes evident:

(a) While the primary purpose was to establish a method for forming leading edge aircraft nacelle inlet skins, there are numerous sheet metal shapes that will benefit from this method.
(b) The ability to rearrange sheet metal shapes without thinning will eliminate hours of hand labor to meet the engineering specifications of thickness.
(c) Nacelle inlets of a constant thickness simplifies stress analysis for hailstones and birdstrikes. Weight prediction is simplified.
(d) Singular dies are used, saving non-recurring cost. The singular dies can be poured to a mold utilizing plastic faces. Aluminum can then be formed in as clad condition without scratches.
(e) Perforated shapes can be formed by combining them with a slave sheet of rubber or metal. Perforated holes will have little or no elongation.
(f) Thermoplastic parts can be formed by combining them with a slave sheet.
(g) Shapes can be formed either over male surfaces or in female cavities.

SUMMARY

Accordingly the reader will see that a multitude of materials can be formed in this facility, without thinning, cost effectively, and with minimal contamination in that Nacelle leading edge inlet shapes and similar shapes can be formed without thinning or wrinkling.

Non-recurring cost of forming tools is reduced as singular dies are used instead of two matched dies.

Dies for low temperature forming will be poured to a mold. They will have a smooth plastic face, allowing aluminums to be formed without scratches.

Perforated shapes can be formed using a slave sheet of rubber or metal depending on temperature.

Perforate holes will have minimal elongation as the reshaping does not stretch the holes.

It is equally feasible to form small laser cut laminar flow perforations and large punched perforations.

The facility has provisions for heat and vacuum/argon gas forming of titaniums or other materials that require a clean atmosphere. Titaniums can be formed almost contaminent free.

Thermoplastics can be formed with the aid of a slave sheet.

Shapes can be formed on male surfaces or female surfaces.

OPERATION—FIGS. 1 TO 9

This facility has been designed to provide several services in a small area. This is the same facility described in the patent application "A METHOD OF HEAT ASSISTED SHEET METAL FORMING IN 360 DEGREE SHAPES". The sheet metal preforms shown in that system will be required. The following are the steps necessary to produce a nacelle leading edge inlet shape and similar shapes:

(a) A multi-purpose holder 32 is installed with the die and case handling winch 18 to the mount ring 24 with a framework 48 which penetrates a lower plunger 36. Said holder 32 supports a double action actuator 34 which is attached to the lower plunger 36 in the extended position. Line 42 is attached to the multi-purpose holder 32 and line 44 is attached to actuator 34. The lines are attached near the centerline of the sheet metal shape 26B so that there is no interference with the plungers 36.

(b) A preform shape 26 is lifted with the part handling winch 16 and installed over the holder 32 resting on the lower plunger 36. Plunger seal retainer 36B along with O-Rings 38 and 40 is secured providing a lower seal to the multi-purpose holder 32 and the sheet metal preform 26 respectfully. Upper plunger 36 is secured to the actuator 34 in the extended position. Seal retainer 36B and O-Rings 38 and 40 are installed. Inflatable seals 52 and 54 are an alternate to the O-rings 38 and 40.

(c) Die 30B is installed in place with the die handling winch 18. Die 30 is installed onto die 30B.

(d) A case 28 is then installed over the dies with the case and die winch 18. The case has a tight fit over the dies as it resist all pressures. The case compresses a lower seal 50 to the base 22.

(e) When forming materials that need a clean atmosphere such as titaniums a vacuum can be pulled on the outside of the preform 26. The inside of preform 26 is sealed to multi-purpose holder 32 and oxygen can be evacuated with argon gas delivered through the delivery tube 42.

(f) The controller/recorder 20 causes heat to reach the proper forming temperature if required and causes gas to be applied to 26 at a controlled rate as it causes the double action actuator 34 to retract the plungers 36. The synchronized action causes the sheet metal to contact and take the shape of the dies 30 and 30B. If aluminum, forming is halted before final shaping. Temperature is reduced to room temperature.

(g) All pressures are relieved. The case 28 is removed with the winch 18. The bond die 30 is removed with the winch 18. The plungers 36 are extended, freeing them from the sheet metal shape 26B. The upper plunger 36 is removed. The sheet metal shape 26B is removed. The aluminum sheet metal shape is solution treated and water quenched.

(h) Immediately after water quenching the shape 26B is re-installed to the lower die 30B. The upper die 30 is re-installed. The upper plunger is reinstalled. Seals are activated. The sheet metal shape is final formed using gas pressure only at appropriate temperature for artificial age hardening to T62. The material is held under pressure at temperature until artificially age hardened to T62. The temperature is then reduced to room temperature.

(i) All pressures are relieved. The case 28 is removed with the winch 18. The bond die 30 is removed with the winch 18. The plungers 36 are extended freeing them from the sheet metal shape 26B. The upper plunger 36 is removed. The sheet metal shape 26B is removed. A part or parts can now be trimmed from the sheet metal shape 26B.

(j) If the preform 26 is perforated all operations are the same except a slave sheet 46 will go along to resist the gas pressure. The same is true for a thermoplastic part.

(k) By following the operations noted we will end up with contaminent free sheet metal shapes with minimal internal stresses that are per engineering with no thinning.

I claim:

1. Apparatus for forming large 360 degree sheet metal shapes using longitudinal end loading comprising:

a base having a top surface;

a holder mount ring having a top surface and said holder mount ring is secured to said base;

a cylindrical multi-purpose holder having a vertically oriented axis, a top surface, a bottom surface, an outer surface and an inner surface;

means for supporting said multi-purpose holder on said holder mount ring;

a vertically oriented double action actuator mounted inside said cylindrical multi-purpose holder, a delivery tube connected to said double action actuator for delivering hydraulic pressure that will elongate or contract the length of said double action actuator along its vertical axis, said double action actuator having a top end and a bottom end;

a cylindrical lower die having an inner diameter greater than the outside diameter of said multi-purpose holder to provide an annular space there between, said lower die having a bottom surface that rests on said base, said lower die also having an inner surface, an outer surface and a top edge, an annular die cavity is formed in said inner surface adjacent its top edge;

a cylindrical upper die having an inner diameter greater than the outside diameter of said cylindrical multi-purpose holder to provide an annular space therebetween, said upper die having an inner surface, an outer surface and a bottom edge; the bottom edge of said upper die rests on the top edge of said lower die, an annular die cavity is formed in said inner surface adjacent its bottom edge and it mates with the annular die cavity of said lower die;

a cylindrical top plunger having means for securing it to the top end of said double action actuator, said cylindrical top plunger having an inner diameter that is slightly greater than the outer diameter of said cylindrical multi-purpose holder so that it can telescope downwardly over said cylindrical multi-purpose holder, the bottom edge of said cylindrical top plunger telescopes into said annular space between said multi-purpose holder and said cylindrical upper die where it would contact the upper edge of a cylindrical preform to which longitudinal end loading would applied; and a cylindrical bottom plunger having means for securing it to the bottom end of said double action actuator, said cylindrical bottom plunger having an inner diameter that is slightly greater than the outer diameter of said cylindrical multi-purpose holder so that it can telescope upwardly over said cylindrical multi-purpose holder, the top edge of said cylindrical bottom plunger telescopes into said annular space between multi-purpose holder and said cylindrical lower die where it would contact the lower edge of a cylindrical preform to which longitudinal end loading would be applied.

2. Apparatus for forming large 360 degree sheet metal shapes using longitudinal end loading as recited in claim 1 further comprising means for supplying pressurized gas to said annular space between the outside surface of said multi-purpose holder and the inner surface of said upper and lower dies so as to cause a cylindrical preform placed in said annular preform to elongate transversely into the respective die cavities of said upper and lower dies and taking the shape approximating that of said cavities.

3. Apparatus for forming large 360 degree sheet metal shapes using longitudinal end loading as recited in claim 2 further comprising a case having a bottom edge and a bottom surface, said case having a cavity formed in its bottom surface that allows it to be placed over said cylindrical top plunger, said upper die and said lower die; the bottom edge of said case rests on the top surface of said base.

4. Apparatus for forming large 360 degree sheet metal shapes using longitudinal end loading as recited in claim 3 further comprising means for sealing the bottom surface of said case to the top surface of said base.

5. Apparatus for forming large 360 degree sheet metal shapes using longitudinal end loading as recited in claim 1 wherein the bottom edge of said cylindrical top plunger and the top edge of said cylindrical bottom plunger have means for gripping the respective top and bottom edges of a cylindrical preform to which longitudinal end loading would be applied.

* * * * *